US006088425A

United States Patent [19]

Ono

[11] Patent Number: 6,088,425

[45] Date of Patent: Jul. 11, 2000

[54] X-RAY APPARATUS

[75] Inventor: Katsuhiro Ono, Utsunomiya, Japan

[73] Assignee: Kabushiki Kaisha Toshiba, Kawasaki, Japan

[21] Appl. No.: 09/053,130

[22] Filed: Apr. 1, 1998

[30] Foreign Application Priority Data

Apr. 1, 1997 [JP] Japan ..... 9-082730
Mar. 17, 1998 [JP] Japan ..... 10-066381

[51] Int. Cl.[7] ..... H05G 1/36

[52] U.S. Cl. ..... 378/117; 378/118

[58] Field of Search ..... 378/101, 113, 378/114, 117, 118, 109, 110, 111, 112

[56] References Cited

U.S. PATENT DOCUMENTS

| | | | |
|---|---|---|---|
| 3,939,352 | 2/1976 | Mester . | |
| 4,032,788 | 6/1977 | Stege et al. | 378/118 |
| 4,160,906 | 7/1979 | Daniels et al. . | |
| 4,363,971 | 12/1982 | Ochmann | 378/110 |
| 4,641,332 | 2/1987 | Gerkema | 378/125 |
| 4,819,259 | 4/1989 | Tanaka | 378/125 |
| 5,809,106 | 9/1998 | Kitade et al. | 378/132 |

FOREIGN PATENT DOCUMENTS

| | | |
|---|---|---|
| 793404A2 | 9/1997 | European Pat. Off. . |
| 57-005298 | 1/1982 | Japan . |
| 57-050359 | 10/1982 | Japan . |
| 59-217995 | 12/1984 | Japan . |

OTHER PUBLICATIONS

Patent Abstracts of Japan, vol. 006, No. 064 (E–103), Dec. 1982 re JP 57005298A.

*Primary Examiner*—David P. Porta
*Assistant Examiner*—Drew A. Dunn
*Attorney, Agent, or Firm*—Pillsbury Madison & Sutro Intellectual Property

[57] ABSTRACT

A rotary anode type X-ray tube is controlled by an X-ray emission control device. In the X-ray emission control device, the maximum permissible storage heat quantity which can be applied to the rotary anode of the X-ray tube is set, the anode storage heat quantity which is lowered based on the cooling characteristic of the rotary anode is calculated, the present anode storage heat quantity is calculated, and the imaginary anode storage heat quantity for the next X-ray emitting condition which is derived by calculation using the correction functions based on the anode input power, emission continuation time, anode rotation speed and focal point size, the anode input power of the next predicted X-ray emission, and X-ray emission continuation time is calculated. The maximum permissible storage heat quantity, the present anode storage heat quantity and the imaginary anode storage heat quantity in the next X-ray emitting condition are compared and calculated to determine permission or inhibition of the next X-ray emission. The performance of the mounted X-ray tube is fully utilized by use of the X-ray emission control device, the wait time to the next X-ray emission can always be suppressed to minimum, and the X-ray tube apparatus can be controlled with high speed and high reliability.

6 Claims, 11 Drawing Sheets

TABLE OF CORRECTION FUNCTION OF ANODE INPUT POWER (P)

| ANODE INPUT POWER P=kVp×1 (kW) | CORRECTION FUNCTION K (p) |
|---|---|
| ≦ 30 | 0.90 |
| 32 | 0.92 |
| 34 | 0.96 |
| 36 | 1.00 |
| 38 | 1.04 |
| 40 | 1.07 |
| 42 | 1.12 |
| 44 | 1.16 |
| 46 | 1.20 |
| 48 | 1.24 |
| 50 | 1.28 |

FIG. 12A

TABLE OF CORRECTION FUNCTION OF X-RAY EMISSION CONTINUATION TIME (T)

| X-RAY EMISSION CONTINUATION TIME (T) (SEC) | CORRECTION FUNCTION L (T) |
|---|---|
| 0.5 | 1.0 |
| 1.0 | 1.03 |
| 2 | 1.07 |
| 5 | 1.17 |
| 10 | 1.36 |
| 15 | 1.51 |
| 20 | 1.64 |
| 30 | 1.86 |
| 40 | 2.00 |
| 50 | 2.07 |
| 60 | 2.11 |

FIG. 12B

TABLE OF CORRECTION FUNCTION OF FOCAL POINT SIZE (f)

| FOCAL POINT SIZE (f) | CORRECTION FUNCTION L (T) |
|---|---|
| SMALL | 1.30 |
| MEDIUM | 1.15 |
| LARGE | 1.00 |

FIG. 12C

TABLE OF CORRECTION FUNCTION OF ANODE ROTATION SPEED (r)

| ANODE ROTATION SPEED (r) (rps) | CORRECTION FUNCTION M (r) |
|---|---|
| 40 | 1.23 |
| 45 | 1.16 |
| 50 | 1.10 |
| 55 | 1.05 |
| 60 | 1.00 |
| 65 | 0.96 |

FIG. 12D

X-RAY APPARATUS

BACKGROUND OF THE INVENTION

This invention relates to an X-ray apparatus such as an X-ray CT scanner and more particularly to an X-ray apparatus capable of emitting X-rays with high reliability, high efficiency and high-speed control.

For example, in a computerized tomograph apparatus which is widely used as a CT scanner, an industrial X-ray photograph apparatus for general medical treatment, or X-ray apparatus such as an X-ray exposure apparatus, a rotary anode type X-ray tube is used as an X-ray emission source in many cases. As is well known in the art, in the rotary anode type X-ray tube, a disk-like rotary anode is mechanically supported by a rotary structure and a stationary structure having a bearing disposed therebetween and a rotating driving power is supplied to a stator electromagnetic coil arranged outside a vacuum container corresponding to the position of the rotary structure so as to emit an electron beam from a cathode and apply the electron beam to the target surface of the rotary anode to emit X-ray while it is being rotated at high speed.

The bearing portion of the rotary anode type X-ray tube is constructed by an anti-friction bearing such as a ball bearing or a hydrodynamic pressure type slide bearing having a helical groove formed in the bearing surface and using a metal lubricant such as gallium (Ga) or gallium-indium-tin (Ga—In—Sn) alloy which is kept in the liquid form at least during the operation.

Examples of the rotary anode type X-ray tube using the latter hydrodynamic pressure type slide bearing are disclosed in Jpn. Pat. Appln. KOKOKU Publication No. 60-21463 (U.S. Pat. No. 4,210,371), Jpn. Pat. Appln. KOKAI Publication No. 60-97536 (U.S. Pat. No. 4,562,587), Jpn. Pat. Appln. KOKAI Publication No. 60-117531 (U.S. Pat. No. 4,641,332), Jpn. Pat. Appln. KOKAI Publication No. 60-160552 (U.S. Pat. No. 4,644,577), Jpn. Pat. Appln. KOKAI Publication No. 62-287555 (U.S. Pat. No. 4,856,039), Jpn. Pat. Appln. KOKAI Publication No. 2-227947 (U.S. Pat. No. 5,068,885), or Jpn. Pat. Appln. KOKAI Publication No. 2-227948 (U.S. Pat. No. 5,077,775), for example.

The rotary anode type X-ray tube which is widely practiced in the prior art has a structure as shown in FIG. 1. That is, a disk-like rotary anode 11 is fixed on a shaft 12. The shaft 12 is fixed on a cylindrical rotary structure 13 which is formed of closely engaged iron and copper cylinders. The rotary structure 13 is fixed on a rotary shaft 14 arranged inside thereof. A cylindrical stationary structure 15 is arranged around the rotary shaft 14. A ball bearing 16 is arranged between the rotary shaft 14 and the stationary structure 15.

The disk-like rotary anode 11 has a thick base body 11*a* of molybdenum (Mo) and a thin target layer 11*b* formed of tungsten (W) alloy containing a small amount of rhenium (Re) on the inclined surface of the base body 11*a*.

When an X-ray photograph is taken by use of the X-ray apparatus using the rotary anode type X-ray tube with the above structure, an electron beam emitted from the cathode 17 is applied to the focal point track surface of the target layer 11*b* to emit X-ray (X) while the rotary anode 11 is being rotated at an anode rotation speed of 150 rps (revolutions per second) or more, for example. Heat generated in the portion of the target layer is transmitted to the Mo base body 11*a* and stored in the rotary anode, and at the same time, it is gradually radiated by radiation.

In recent years, in the CT scanner, for example, the operation for successively taking tomograms of a to-be-photographed object in a helical scanning mode for several tens of seconds, for example, is applied. When the X-ray is thus successively emitted from the rotary anode type X-ray tube for a long period of time, it often becomes necessary to limit the successive emission of the X-ray, particularly, because of a rise in the temperature of the anode of the X-ray tube. That is, the temperature of the rotary anode 11 of the X-ray tube varies such that the average temperature (Tf) of the focal point track area (F) indicated by broken lines at a certain time rises with the continuation time of the X-ray emission as schematically shown in FIGS. 2A and 2B. At the above certain time, the instantaneous temperature (Ts) of the electron beam incident point (S), that is, the X-ray focused point naturally reaches a temperature higher than the average temperature (Tf) of the focal point track area. Further, the average temperature (Tb) of the base body 11*a* is naturally set to a temperature lower than the average temperature (Tf) of the focal point track area. However, the temperatures of the respective portions rise with the continuation time of the X-ray emission.

The temperature (Tf) of the focal point track area indicates an average temperature of the focal point track area except the incident point (S) on which the electron beam is incident at a certain time, and the temperature (Ts) of the electron beam incident point indicates an achieved maximum temperature of the electron beam incident point at the instant. The average temperature (Tb) of the anode base body rises by heat storage or decreases by heat radiation according to a difference between the input heat quantity by the electron beam incident on the anode and the radiated heat quantity by heat radiation or the like.

The temperature (Ts) of the electron beam incident point becomes a peak temperature by an instantaneous input heat quantity by incidence of the electron beam in addition to the temperature (Tf) of the focal point track area only at the time of incidence of the electron beam. Further, the temperature (Ts) of the electron beam incident point is relatively and largely influenced by the anode rotation speed since the instantaneous heat storage action at the electron beam incident point becomes different depending on the rotation speed of the anode. That is, if the temperatures are compared with the focal point track area temperature (Tf) kept at the same value, the temperature (Ts) of the electron beam incident point reaches a higher temperature when the anode rotation speed is low and the temperature (Ts) of the electron beam incident point is set to a relatively low temperature when the anode rotation speed is high.

As is disclosed in TOSHIBA Review Vol. 37, No. 9, pp777 to 780, the temperatures of the respective portions of the rotary anode can be expressed by the following approximation.

$$Ts=Tf+(2\cdot P\cdot w^{-1/2})/[S\cdot(\pi\cdot\rho\cdot C\cdot\lambda\cdot v)^{-1/2}]$$

where (P) indicates the power of the electron beam incident on the anode 11 or the anode input power, (w) indicates the electron beam width in the anode rotating direction (the radial direction of the anode) or the focal point size, (S) indicates the area of a surface on which the electron beam is incident, (ρ) indicates the density of the material of the anode surface portion, (C) indicates the specific heat thereof, (λ) indicates the thermal conductivity thereof, and (v) indicates the circumferential speed of the electron beam incident point.

Further, if a rapid temperature rise occurring at the focused position of the rotary anode target is set to (ΔTs) and a temperature rise occurring on average on the ring-like focal point track area is set to (ΔTf), then the following relation is obtained.

$$Ts=Tb+\Delta Tf+\Delta Ts=Tf+\Delta Ts\ \Delta Ts=(2\cdot P\cdot w^{-1/2})/[S\cdot(\pi\cdot\rho\cdot C\cdot\lambda\cdot v)^{-1/2}]$$

As is clearly understood from the above equations, the rapid temperature rise (ΔTs) occurring in the focused position of the rotary anode target is approximately proportional to the anode input power (P), approximately proportional to the square root of the focal point size, approximately inversely proportional to the electron beam incident area (S), and approximately inversely proportional to the square root of the rotation speed of the anode. On the other hand, it is known that heat radiation from the surface of, the rotary anode target is proportional to the absolute temperature of the anode target surface to the fourth power.

In the operation of the X-ray tube, the temperature rises in the respective portions of the rotary anode must be controlled so as not to cause evaporation, melting, deform of the anode material and damage of the connecting portion. If the target layer is formed of tungsten or tungsten alloy, for example, it is generally considered that the instantaneous temperature (Ts) of the focal point must be set to approx. 2800° C. or less, (ΔTf) must be set in a range of approx. 100 to 500° C., and (ΔTs) must be set in a range of approx. 1300 to 1500° C. Therefore, the upper limit of the average temperature (Tb) of the anode base body is in fact considered to be approx. 1000° C.

When the X-ray photographing is repeatedly effected under various X-ray emission conditions, it is practically difficult to actually and accurately measure the average temperature (Tb) of the anode base body, the focal point temperature (Ts) or the average temperature (Tf) of the focal point track area. This is because the measurement error in the average temperature (Tb) of the anode base body becomes large since a difference in the temperature distribution is large when the X-ray is emitted only for a short period of time. Further, the respective temperatures (Ts), (Tf) of the focal point areas are extremely high and significantly vary as described before, it is difficult to measure the temperatures with high precision and the measurement is strongly influenced by the X-ray emitting conditions such as the anode input power, focal point size, and anode rotation speed. Further, it is not impossible to calculate the respective temperatures by use of a computer, but it is impractical from the viewpoint of the calculation speed and cost of the computer.

Therefore, an X-ray apparatus constructed to control the X-ray emission based on the anode storage heat quantity (Hu) is widely used. As is well known in the art, the anode storage heat quantity (Hu) is expressed by the anode input power and the period of supply time thereof, that is, the product thereof with the continuation time of X-ray emission (Hu=kV×mA×T). Further, if the density of the material of the rotary anode target is set to ($\tilde{n}$), the specific heat is (C), the volume is (Vm) and the base body temperature is set to (Tb), then the heat quantity (Hu) of the anode target is approximated by Hu=Σ(ρ×C×Vm×Tb).

Therefore, since the base body temperature (Tb) is limited to approx. 1000° C. as described before, the maximum permissible storage heat quantity of the anode target is determined as a value inherent to the rotary anode target. For this reason, it is a common practice to control and manage the anode storage heat quantity so as not to exceed a previously determined maximum permissible value. The rise and fall characteristics of the anode storage heat quantity of the mounted rotary anode type X-ray tube are shown in FIG. 3, for example, as is well known in the art. That is, the rise characteristic (St) of the anode storage heat quantity rises with the X-ray emission continuation time (T) and the rate of the rise becomes higher depending on the input power (P=anode peak voltage×anode average current) to the rotary anode. The maximum permissible storage heat quantity (Qlm) of the rotary anode is the upper limit heat quantity which can be safely stored in the anode and this value is set by taking the safety factor into consideration.

The cooling characteristic after the input to the anode, that is, the X-ray emission is terminated is a characteristic in which the anode storage heat quantity falls according to the cooling curve (Ct) inherent to the rotary anode type X-ray tube from the maximum permissible storage heat quantity (Qlm). That is, even if the achieved anode storage heat quantity is different, the heat quantity substantially falls according to the cooling curve (Ct).

As described before, since the characteristics of the anode storage heat quantity of the X-ray tube are inherent characteristics which the mounted X-ray tube has, they can be grasped substantially accurately according to the history of the ON and OFF states of the X-ray emission. Therefore, as shown in FIG. 4, the X-ray emission is controlled so that the anode storage heat quantity of the mounted X-ray tube will not exceed the maximum permissible storage heat quantity (Qlm). In FIG. 4, the period from the time t1 to t2 is the X-ray emission continuation time, the period from the time t2 to t3 is the cooling period, the period from the time t3 to t4 is the X-ray emission continuation period and the period after the time t4 is the cooling period.

Since it is possible to predict from the above characteristics that the X-ray photographing can be made under the predicted conditions such as the anode input power and the X-ray emission continuation time in the next cycle, a system for locking the apparatus so as not to permit the X-ray emission or similar control means is provided on the X-ray apparatus. The inventions related to the above technology are disclosed in the Patent Publication or Specification of Jpn. Pat. Appln. KOKAI Publication No. 57-5298, Jpn. Pat. Appln. KOKAI Publication No. 58-23199, Jpn. Pat. Appln. KOKAI Publication No. 59-217995, Jpn. Pat. Appln. KOKAI Publication No. 59-217996, Jpn. Pat. Appln. KOKAI Publication No. 62-69495, Jpn. Pat. Appln. KOKAI Publication No. 6-196113, U.S. Pat. No. 4,225,787, U.S. Pat. No. 4,426,720, and U.S. Pat. No. 5,140,246, for example.

As shown in FIG. 5A, the anode storage heat quantity is the same in a case (b) where the input power (P) to the anode is 20 kW and the X-ray emission continuation time is 50 sec and a case (c) where the anode input power (P) is 50 kW and the X-ray emission continuation time is 20 sec, for example, and the same value is used for control in the calculations for the conventional X-ray photographing control.

However, the temperature (Ts) of the electron beam incident point of the rotary anode and the average temperature (Tf) of the focal point track area reach temperatures higher than those attained based on the power ratio in a case where the anode input power (P) is larger as shown in FIG. 5C in comparison with a case where the anode input power (P) is smaller as shown in FIG. 5B. That is, the temperature (Tsc) of the electron beam incident point set 20 sec after the X-ray emission is started with the input power (P) of 50 kW reaches a temperature higher than 2.5 times which is the anode input power ratio in comparison with the temperature (Tsb) of the electron beam incident point set 50 sec after the X-ray emission is started with the input power (P) of 20 kW.

The reason is that a certain period of time is required for the heat conductivity or diffusion from the focused point of the rotary anode and the focal point track area to the anode base body and the temperature (Tf) of the focal point track area becomes excessively higher as the anode input power (P) is higher even if the anode input heat quantity (P×T) is the same, that is, it becomes rapidly higher than that determined by the ratio of the input power (P) in a short period of time. As a result, the temperature (Ts) of the electron beam incident point which is superposed thereon and attained becomes rapidly high in a short period of time. As described above, if the temperature (Ts) of the electron beam incident point becomes close to or exceeds the melting point of the focal point surface, the evaporation or melting phenomenon of the focal point surface material occurs to cause fatal damage.

Therefore, conventionally, in order to previously prevent the above problem, the maximum permissible storage heat quantity (Qlm) of the anode storage heat quantity shown in FIG. 4 is determined to a relatively low value by taking the above phenomenon in a case where the anode input power (P) is highest into consideration and taking the sufficiently large safety factor. According to this, the X-ray apparatus can be safely operated without causing any damage on the rotary anode even if the assumable highest anode input power is used. However, in the case of low anode input power, the control operation is performed so as not to permit the next X-ray emission until the anode is cooled to a temperature than necessary. Thus, in the conventional X-ray apparatus, the wait time for the next X-ray emission becomes unnecessarily longer in many cases and the performance of the mounted X-ray tube cannot be fully utilized.

In a conventional X-ray apparatus including an X-ray tube having a rotary anode with a laminated structure of a graphite base body soldered, for example, on the rear surface of the relatively thin Mo base body, the heat conductivity from the focal point track area to the graphite base body is worsen, the melting point of solder is low, and the soldered portion tends to be separated and the maximum permissible storage heat quantity (Qlm) of the anode storage heat quantity is set to a smaller value.

An object of this invention is to provide an X-ray apparatus which can be automatically controlled with high speed and high reliability and always utilize the performance of a mounted X-ray tube, that is, the heat quantity to the maximum extent, and always suppress the wait time for the next X-ray photographing, that is, X-ray emission to minimum.

BRIEF SUMMARY OF THE INVENTION

According to the invention, there is provided an X-ray apparatus comprising:

a rotary anode type X-ray tube including a rotary anode having an X-ray emission target section, a cathode for emitting an electron beam to the target section of the rotary anode, a rotary structure to which the rotary anode is fixed, a stationary structure for rotatably supporting the rotary structure, and a bearing disposed between the rotary structure and the stationary structure;

a power supply device for causing the electron beam to be incident on the rotary anode of the X-ray tube to emit X-ray; and an X-ray emission control device for controlling the power supply device to control the X-ray emission;

wherein the X-ray emission control device includes:

first setting means for setting data information corresponding to a maximum permissible storage heat quantity (Qlm) of the rotary anode;

first calculating means for calculating data information corresponding to a present anode storage heat quantity (Qt) based on the cooling characteristic (Ct) of the rotary anode;

second calculating means for calculating data information corresponding to a next predicted anode input total heat quantity (Qsn) by calculation using data information corresponding to the anode input power (P) and X-ray emission continuation time (T) from the start of the X-ray emission to the end of the X-ray emission in the next predicted X-ray emitting condition;

second setting means for setting data information which is at least one of data information corresponding to a correction function (K(p)) determined depending on the anode input power (P) of the X-ray tube, data information corresponding to a correction function (L(T)) determined depending on the X-ray emission continuation time (T), data information corresponding to a correction function (M(f)) determined depending on the X-ray focal point size (f), and data information corresponding to a correction function (N(r)) determined depending on the anode rotation speed;

third calculating means for calculating data information corresponding to a next imaginary anode storage heat quantity (Qs) in the next X-ray emitting condition by calculation using the at least one data information set by the second setting means and data information corresponding to the next predicted anode input total heat quantity (Qsn); and fourth calculating means for deriving data information indicating permission or inhibition of the X-ray emission in the next X-ray emitting condition by calculation using data information corresponding to the maximum permissible storage heat quantity (Qlm), the present anode storage heat quantity (Qt) and the next imaginary anode storage heat quantity (Qs).

According to the invention, there is also provided an X-ray apparatus comprising:

an X-ray apparatus comprising:

a rotary anode type X-ray tube including a rotary anode having an X-ray emission target section, a cathode for emitting an electron beam to the target section of the rotary anode, a rotary structure to which the rotary anode is fixed, a stationary structure for rotatably supporting the rotary structure, and a bearing disposed between the rotary structure and the stationary structure;

a supply device for causing the electron beam to be incident on the rotary anode to emit X-ray; and an X-ray emission control device for controlling the power supply device to control the X-ray emission;

wherein the X-ray emission control device includes:

first setting means for setting data information corresponding to a maximum permissible storage heat quantity (Qlm) of the rotary anode;

first calculating means for calculating data information corresponding to a present anode storage heat quantity (Qt) based on the cooling characteristic (Ct) of the rotary anode;

second calculating means for calculating data information corresponding to a next predicted anode input total heat quantity (Qsn) by calculation using data information corresponding to the anode input power (P) and X-ray emission continuation time (T) from the start of the X-ray emission to the end of the X-ray emission in the next predicted X-ray emitting condition;

second setting means for setting data information which is at least one of data information corresponding to a correction function (K(p)) determined depending on the anode input power (P) of the X-ray tube, data information corresponding to a correction function (L(T)) determined depending on the X-ray emission continuation time (T), data information corresponding to a correction function (M(f)) determined depending on the X-ray focal point size (f), and data information corresponding to a correction function (N(r)) determined depending on the anode rotation speed (r);

third calculating means for calculating data information corresponding to a next imaginary permissible limit storage heat quantity (Qln) in the next X-ray emitting condition by subtracting an amount corresponding to the correction function data information from the maximum permissible storage heat quantity (Qlm) by calculation using the at least one data information set by the second setting means and data information corresponding to the next predicted anode input total heat quantity (Qsn); and fourth calculating means for deriving data information indicating permission or inhibition of the X-ray emission in the next X-ray emitting condition by calculation using data information corresponding to the next imaginary permissible limit storage heat quantity (Qln), the present anode storage heat quantity (Qt) and the next predicted anode input total heat quantity (Qsn).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

FIGS. 12A, 12B, 12C and 12D are tables showing the concepts of set functions of a calculation table shown in FIG. 11;

DETAILED DESCRIPTION OF THE INVENTION

Figure 1:
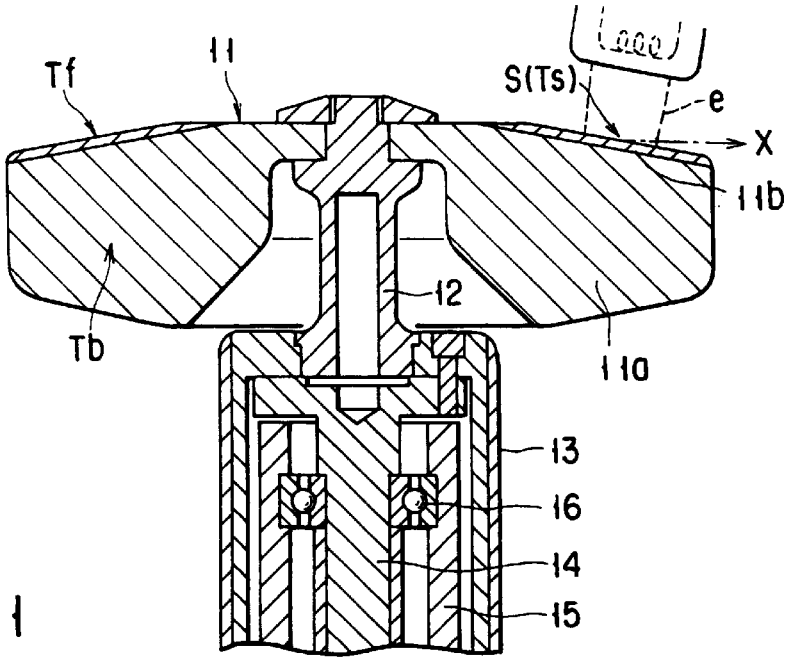
FIG. 1 (PRIOR ART)
FIG.1 is a partial cross section schematically showing the structure of a conventional rotary anode type X-ray tube.
Figure 2A:
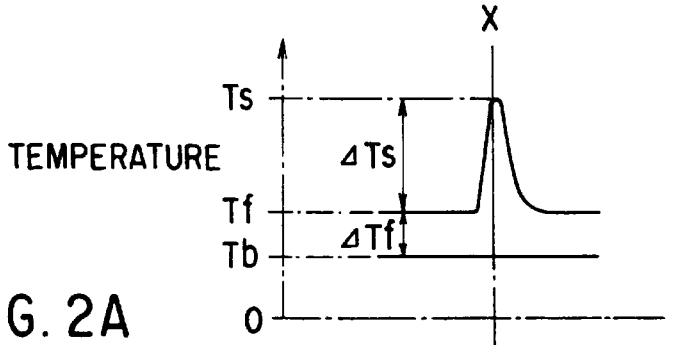
FIG. 2A (PRIOR ART)
FIGS. 2A and 2B are a graph showing the temperature distribution on the general rotary anode shown in FIG. 1 and a plan view of the rotary anode.
Figure 2B:
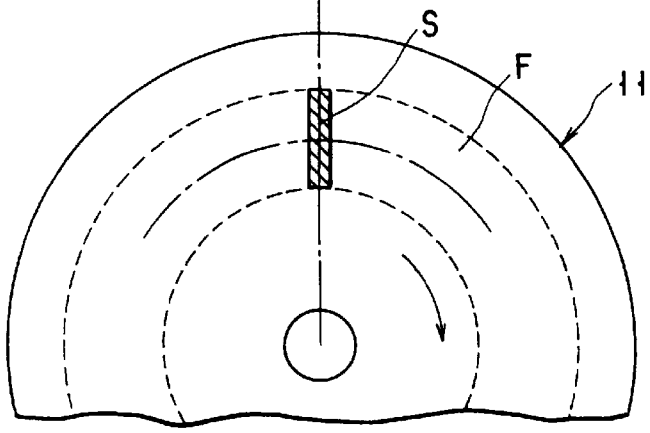
FIG. 2B (PRIOR ART)

Hereinafter, referring to the accompanying drawings, an X-ray apparatus according to an embodiment of the present invention will be explained. The same parts are shown by corresponding reference characters throughout the drawings.

Figure 6:
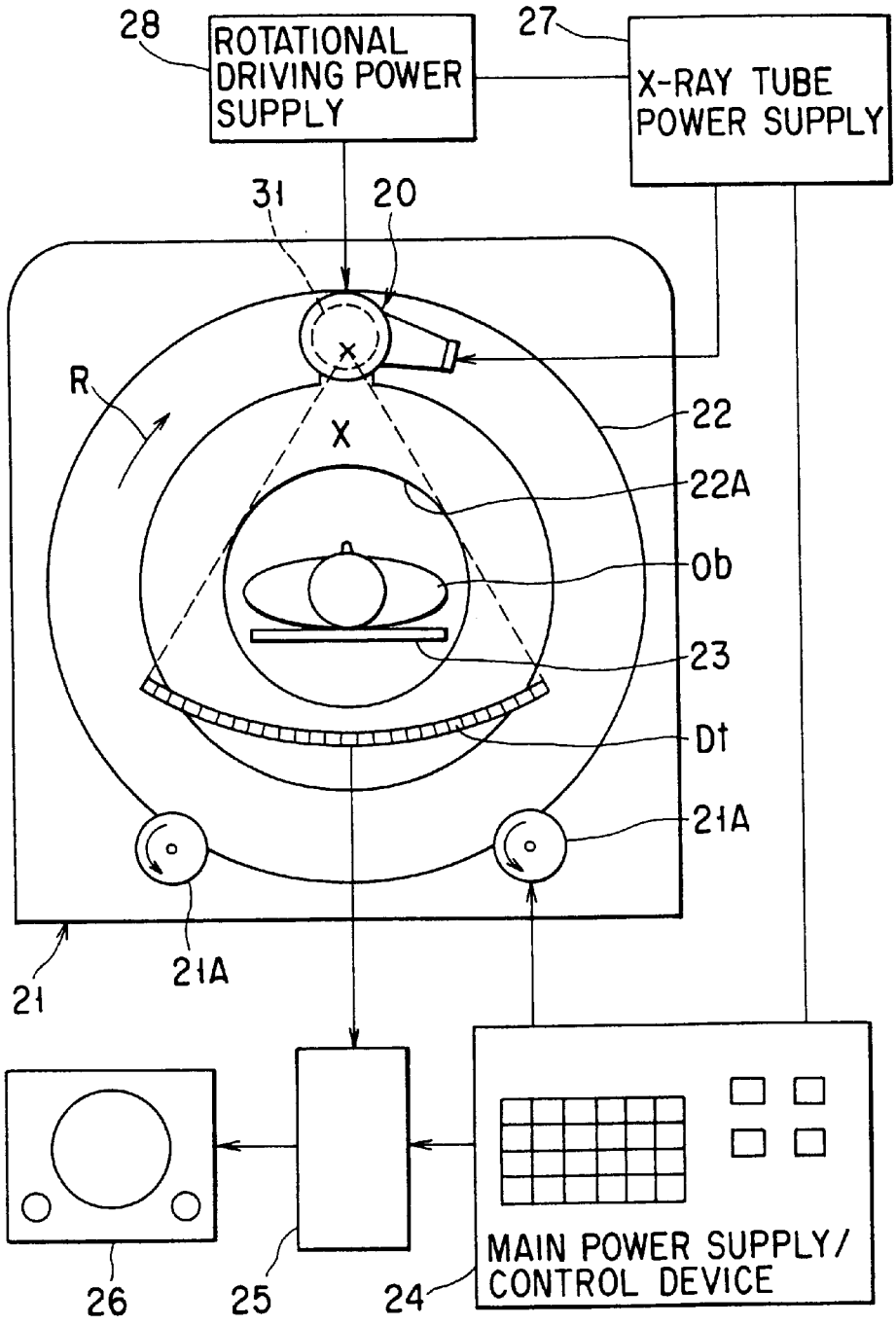
FIG. 6 is a block diagram schematically showing a rotary anode type X-ray tube according to an embodiment of this invention and a peripheral device thereof.

A CT scanner or a tomograph, whose schematic configuration is shown in FIG. 6, has a ring-like rotary frame 22 provided on a gantry 21 in such a manner that the frame 22 can rotate. Inside a dome 22A formed in the central section of the rotary frame 22, an advancing and retreating bed 23 and a subject for photography Ob put on the bed are housed. The rotary frame 22 is rotated around the subject Ob in the direction of arrow R by a rotational driving device 21A operated under the control of a main power supply/control device 24.

An X-ray tube device 20 which emits a fan beam of X-rays (X) (shown by dashed lines) toward the subject Ob is provided in a specific position on the rotary frame 22, on the opposite side of which an X-ray detector Dt is arranged and is rotated around the subject Ob during taking X-ray photographs, keeping the positional relationship. The X-ray image signal obtained from the X-ray detector Dt is supplied to a computer image signal processor 25, which then makes calculations on the basis of the signal and sends the resulting image output signal to a CRT monitor 26, which then displays a tomogram of the subject Ob.

The X-ray tube device 20 has a rotary anode X-ray tube 31 secured inside the X-ray tube container. An X-ray tube power supply 27 and a rotational driving power supply 28 output a rotating and operating electric power to the X-ray tube 31.

With the CT scanner, the main power supply/control device 24 can control the rotation of the rotary frame 22, X-ray emission of the X-ray tube and operations of the other parts. The main power supply/control device 24 is provided with a control panel for setting exposing conditions and controlling the start time of the photographing operation as will be described later.

Figure 7:
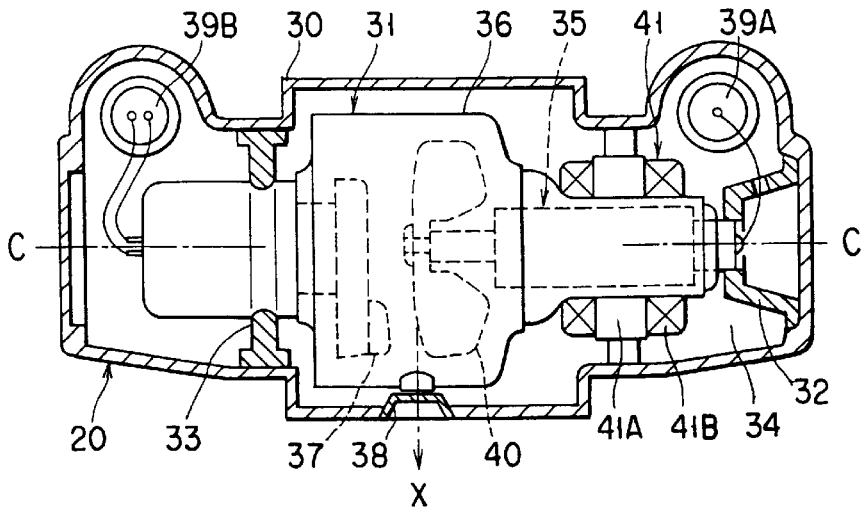
FIG. 7 is a vertical cross section schematically showing the structure of the X-ray tube of FIG. 6.

The X-ray tube device 20 and rotary anode type X-ray tube 31 have the configurations as shown in FIGS. 7 to 10. Specifically, as shown in FIG. 7, the X-ray tube device 20 has the rotary anode type X-ray tube 31 fixed inside an X-ray tube container 30 by insulating supports 32, 33 and an insulating oil 34 is filled in the internal space of the container 30. Further, the X-ray tube device 20 is provided with a stator 41 for rotating the rotary structure 35 of the X-ray tube and the rotary anode 40 for emitting X-rays. In FIG. 7, a reference numeral 36 indicates a vacuum container of the X-ray tube, 37 a cathode, 38 an X-ray emitting gate, 39A an anode-side connection cable receptacle, and 39B a cathode-side connection cable receptacle. The direction of the central axis of rotation of the rotary frame of the CT scanner shown in FIG. 6 and the direction of the central axis C of the X-ray tube are set parallel or almost parallel with each other.

Figure 8:
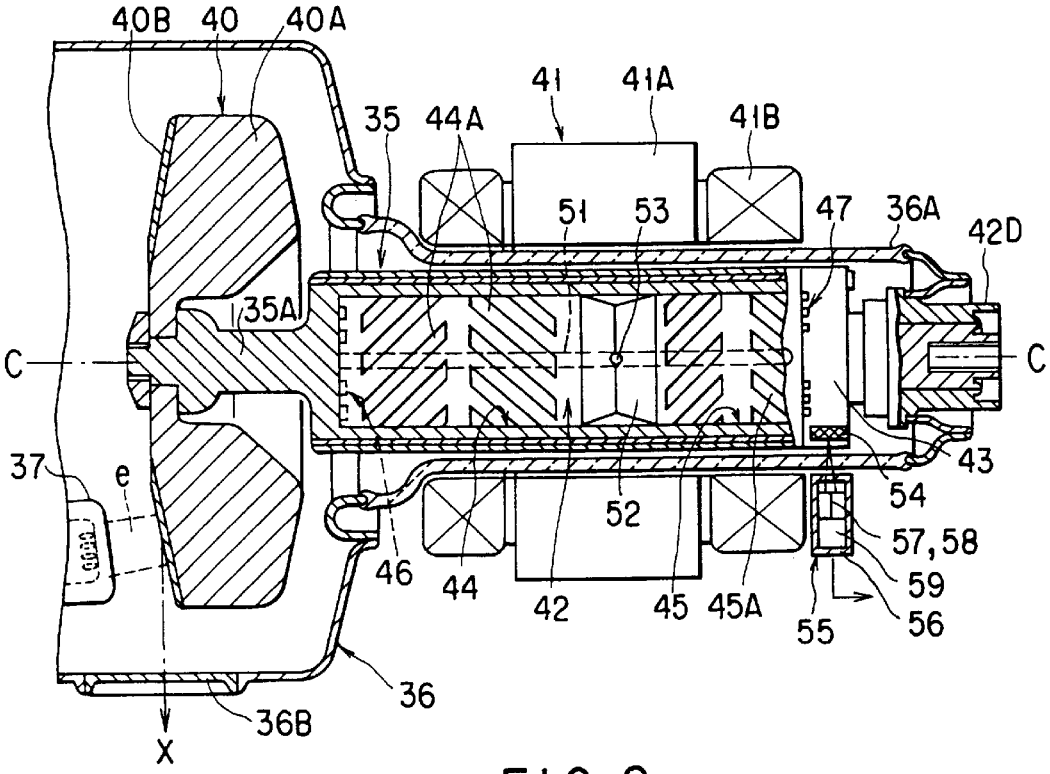
FIG. 8 is a vertical cross section showing part of the X-ray tube of FIG. 6.

As shown in FIGS. 7 and 8, the rotary anode type X-ray tube 31 is provided such that a disk-like rotary anode 40 formed of a heavy metal is integrally fixed on a shaft 35A projecting from one end of the cylindrical rotary structure 35 in the vacuum container 36. The cathode 37 for emitting an electron beam e is arranged so as to face the tapered focal point track surface of the rotary anode 40.

A cylindrical stationary structure 42 is concentrically engaged with the inside of the cylinder rotary structure 35 and a thrust string 43 is secured to the opening of the rotary structure. The end of the stationary structure 42 is an anode terminal 42D, part of which is hermetically joined to the glass cylindrical container section 36A of the vacuum container. The engaging section of the rotary structure 35 and the stationary structure 42 is provided with a pair of radial hydrodynamic slide bearings 44 and 45 and a pair of thrust hydrodynamic slide bearings 46 and 47 as is disclosed in the aforementioned publications.

Figure 9:
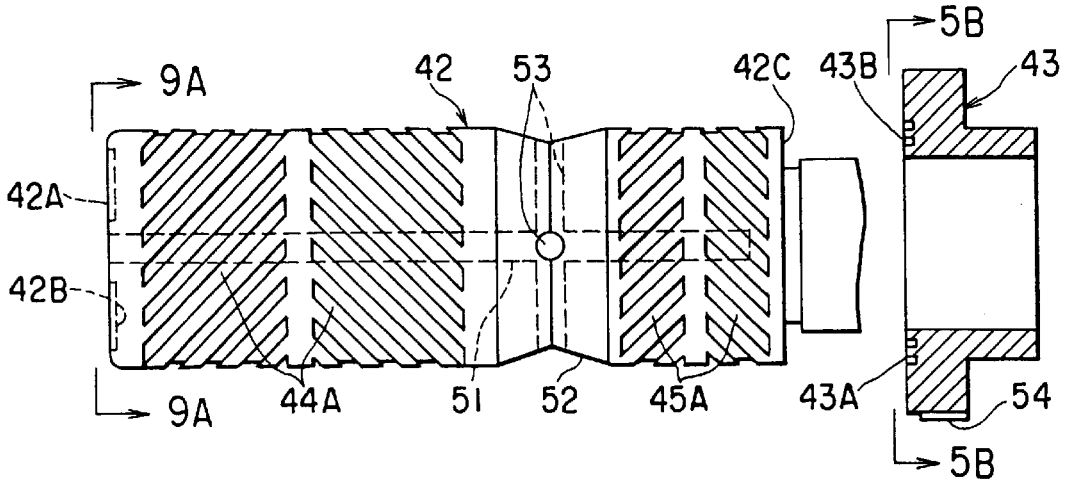
FIG. 9 is a side view showing the stationary and rotary structures shown in FIG. 8.
Figure 10A:
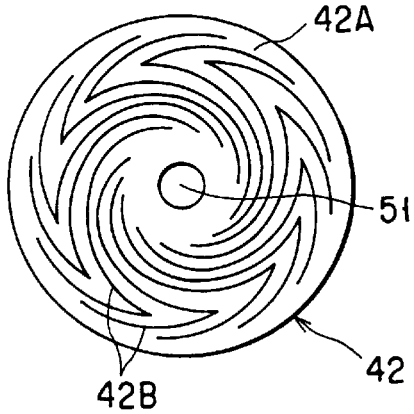
FIGS. 10A and 10B are plan views schematically showing the upper surfaces of the stationary and rotary structures shown in FIG. 9.
Figure 10B:
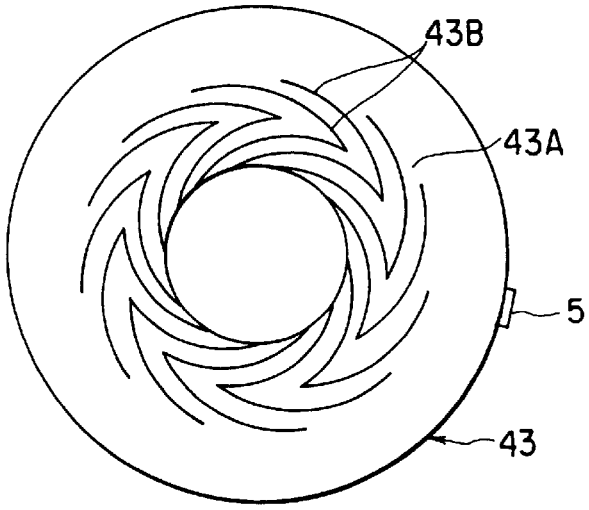

As is partly shown in FIG. 9, the radial hydrodynamic slide bearings 44, 45 are constructed by two pairs of herringbone helical grooves 44A, 45B formed in the outer-peripheral bearing surface of the stationary structure 42 and the internal-peripheral bearing surface of the rotary structure. One thrust hydrodynamic slide bearing 46 is constructed by a circular herringbone helical groove 42B as shown in FIG. 10A formed in the tip bearing surface 42A of the stationary structure 42 and the bottom surface of the rotary structure 35. FIG. 10A is a plan view taken along the line 9A—9A of FIG. 9. The other thrust hydrodynamic slide bearing 47 is constructed by a circular herringbone helical groove 43B as shown in FIG. 10B formed in the bearing surface 43A of the thrust ring 43 serving as part of the rotary structure and a bearing surface 42C of the shoulder of the stationary structure. FIG. 10B is a plan view taken along the line 9B—9B of FIG. 9. The helical grooves formed in the bearing surface constituting each bearing have a depth of approx. 30 ìm.

The bearing surface of each bearing for each of the rotary structure and stationary structure is designed to keep a bearing clearance of approx. 30 ìm in operation. In the stationary structure on the rotational central axis C, a lubricant holder 51 formed of a hole bored in the center of the stationary structure in the axial direction is formed. The outer-peripheral wall of the middle of the stationary structure 42 is slightly tapered to form a small-diameter section 52 and part of the lubricant is accumulated in the cylindrical space produced by the small-diameter section 52.

Further, four radial direction passages 53 leading from the lubricant holder 51 in the central portion to the space of the small-diameter section 52 are formed axial-symmetrically at the same angle. A liquid-metal lubricant of Ga—In—Sn alloy is supplied to the clearance between the rotary structure and stationary structure, the helical groove of each bearing, the lubricant holder 51, the space of the small-diameter section 52, and the internal space including the radial direction passage 53.

The main portion of the rotary structure 35 is constructed by a three-layered cylinder: the innermost cylinder is a bearing cylinder of iron alloy, the middle cylinder is a ferromagnetic cylinder of iron, and the outermost cylinder is a copper cylinder, and the cylinders are integrally engaged and joined with each other. The cylinders function as the rotor of the electromagnetic induction motor in cooperation with the electromagnetic coil of the stator 41 arranged outside the glass cylindrical container section 36A surrounding the rotary structure 35. The stator 41 is provided with a cylindrical iron core 41A and a stator coil 41B wound around the core 41A. As described before, the stator driving power supply 28 supplies a rotational driving power to the stator coil 41B so as to generate a rotational torque in the rotary structure in the X-ray tube.

The rotary anode 40 of the X-ray tube is formed of a base body 40A of refractory metal such as Mo or Mo alloy whose diameter is 140 mm and which is 50 mm thick at maximum, for example, and a heavy metal target layer 40B for X-ray emission which is formed of W or W alloy containing Re with a thickness of 1.5 mm and is integrally formed with the tapered surface of the base body. As described before, the cathode 37 for emitting an electron beam e is arranged so as to face the focal point track area F of the anode. The X-ray (X) generated at the electron beam incident point on the focal point track area is emitted to the exterior through an X-ray emission window 36B constituting part of the vacuum container.

The rotary anode is not limited to the structure in which the base body section and the target section are formed of different metals and, for example, the rotary anode may be formed such that the base body section and the target section are formed of single Mo or Mo alloy as in the rotary anode type X-ray tube for a mammography device.

Further, in this embodiment, a black mark 54 is stuck to part of the outer-peripheral surface of the thrust ring 43 constituting the bottom end of the rotary structure and is located in a position which can be viewed from outside the tube through the glass container section 36A of thee vacuum container. In the position outside the glass container section corresponding to the mark, a rotation speed sensor 55 is arranged. With the rotation speed sensor 55, a laser light oscillationelement 57 and a light-receiving element 58 for receiving the laser light reflected from the surface of the rotary structure are arranged in a casing 56 formed of an X-ray shielding material. Further, the rotation speed sensor 55 includes a signal processing section 59 for controlling the operations of the above two elements and amplifying the received signal and effecting the calculation operation. The above devices are electrically or optically connected to the rotational driving power supply 28 and X-ray emission control device 29 so as to transfer a signal corresponding to the rotation speed therebetween.

The sensor 55 projects a laser beam onto the surface of the rotation thrust ring through the laser light gate formed in the casing 56, receives the laser light reflected and calculates and detects the rotation speed of the rotary structure based on the low reflection intensity of the black mark 54.

Figure 11:
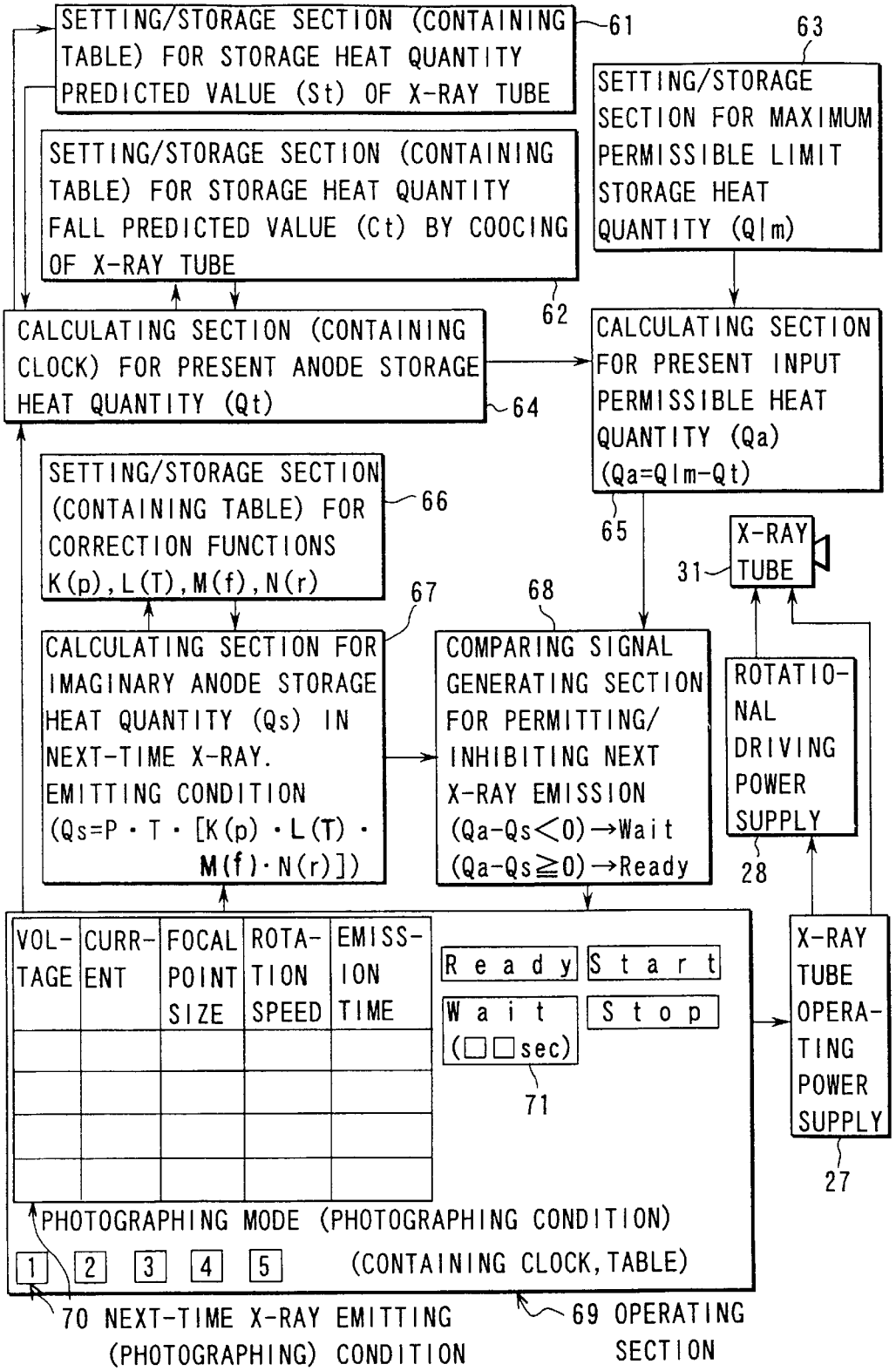
FIG. 11 is a block diagram showing the function of calculation/control means shown in FIG. 6.

As described before, in the CT scanner, the X-ray photographing, that is, the X-ray emission from the X-ray tube is controlled by the main power supply/control device 24. The main power supply/control device 24 has a control function as shown in FIG. 11.

The device has a setting/storage section 61 (which contains a table of calculation data information by a microcomputer as will be described later) for setting and storing a predicted value of storage heat quantity which will rise in the operation of the X-ray tube, that is, the rising predicted value (St) and a setting/storage section 62 (which also contains a table) for setting and storing a predicted value of storage heat quantity which will fall by the cooling operation in the X-ray tube, that is, the falling predicted value (Ct). Further, the device includes a setting/storage section 63 (which also contains a table) for setting and storing a maximum permissible storage heat quantity (Qlm), a calculating section 64 (which contains a clock) for calculating the present anode storage heat quantity (Qt), and a calculating section 65 for calculating the present input permissible heat quantity (Qa). Further, the device includes a setting/storage section 66 for setting and storing the functions K(p), L(T), M(f), N(r), a calculating section 67 for calculating the imaginary anode storage heat quantity (Qs) in the next X-ray emitting condition, a comparison/signal generating section 68 for permitting or inhibiting the next X-ray emission, and an operating section 69 for the device.

The operating section 69 includes a setting section 70 for setting the next X-ray emitting (photographing or exposing) condition, a display section (Ready) for permitting the photographing, a display section (Wait) for displaying the inhibition and wait state of the photographing, a start instruction button switch (Start) for instructing the start of the photographing, and a stop instruction button switch (Stop) for stopping the operation in the course of the operation and contains the clock and table. In the photographing inhibition/wait display section (Wait), wait time required for the X-ray photographing in the set photographing condition to be performed is displayed on the wait time display section 71. As a result, as will be described later, the wait time is sequentially updated based on the result of calculation by the microcomputer after the next photographing condition is set and the wait time required for the next photographing to become possible is informed to the operator.

The condition setting section 70 for the next X-ray emission, that is, X-ray photographing can adequately set an anode voltage (kVp), anode current (I), selected X-ray focal point size (f), anode rotation speed (r) and X-ray emission continuation time (T) which are predicted for the next time. Further, desired combinations of the above photographing conditions or different types of photographing modes are previously set and a control button for selecting photographing mode selecting sections (1, 2, 3, 4, 5) for adequately selecting the above photographing conditions by a simple depressing operation is provided.

The control function sections are connected to transfer data information for calculation and electrical control signals as shown by arrows in FIG. 11 and are electrically connected to the operation power supply 27 for the X-ray tube, rotational driving power supply 28 and X-ray tube 31.

Various data information items calculated by the microcomputer and obtained as the result of calculation indicate the numerical values of the voltage, current, power, time or heat quantity, numerical values converted according to a certain rule, mechanical words, electrical signals, or other type of data information which can be calculated by the microcomputer. In this specification, for clarity, the fact that the data information subjected to the calculation and obtained as the result of calculation is data information for calculation corresponding to the above cases is not always described for each case.

Figure 3:
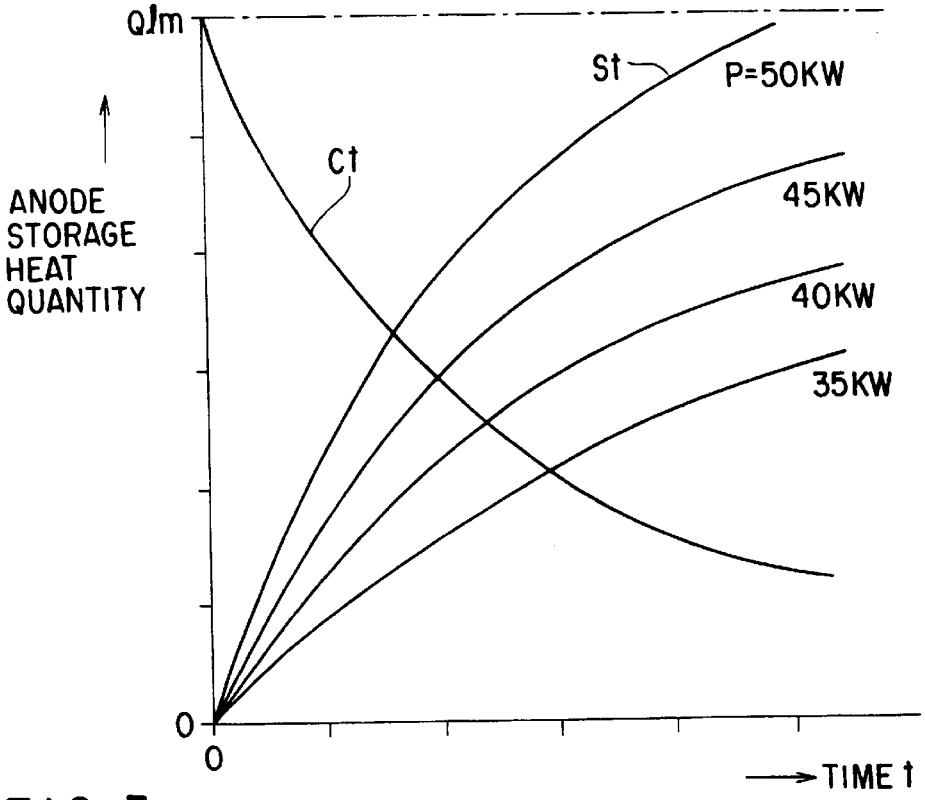
FIG. 3 (PRIOR ART)
FIG. 3 is a characteristic graph showing a variation in the storage heat quantity of the general rotary anode shown in FIG. 1.
Figure 4:
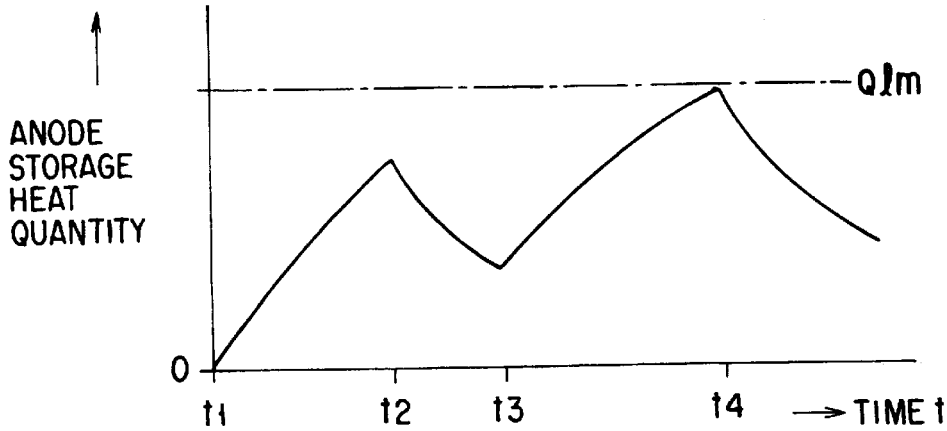
FIG. 4 (PRIOR ART)
FIG. 4 is a graph showing a variation in the anode storage heat quantity when the general rotary anode type X-ray tube shown in FIG. 1 is energized by a general time-control method.
Figure 5A:
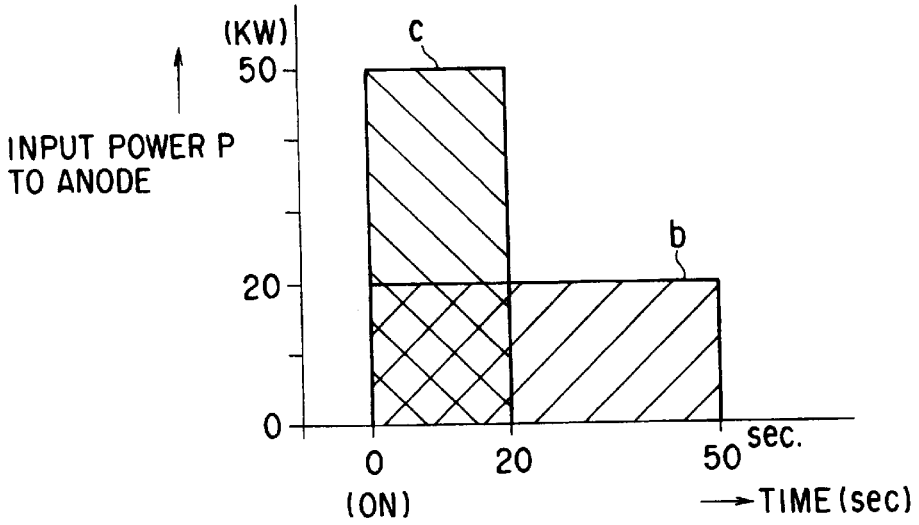
FIG. 5A (PRIOR ART)
FIGS. 5A, 5B and 5C are graphs showing temperature variations of the respective portions of the anode and the anode input power by general control.
Figure 5B:
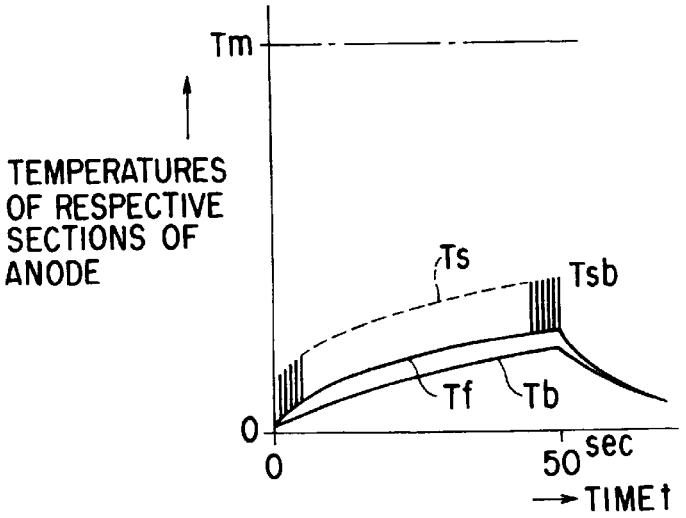
FIG. 5B (PRIOR ART)
Figure 5C:
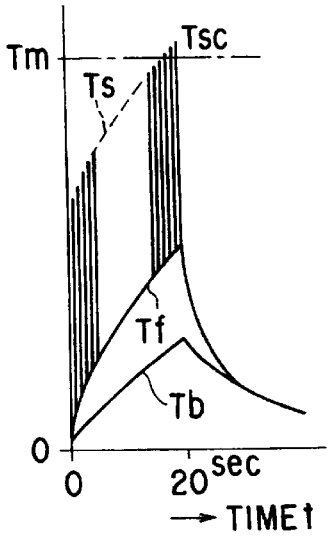
FIG. 5C (PRIOR ART)

The setting/storage section 61 for the storage heat quantity rise predicting value (St) of the X-ray tube contains a data table used as input, storage or readout means for data information for calculation corresponding to the anode storage heat quantity rise characteristic (St) for each anode input power of the mounted rotary anode type X-ray tube as shown in FIG. 3. Further, the setting/storage section 62 for the storage heat quantity fall predicting value (Ct) by the cooling operation of the X-ray tube contains a data table used as input, storage or readout means for data information for calculation corresponding to the fall value from the anode storage heat quantity at the end of X-ray emission according to the cooling curve (Ct) as shown in FIG. 3.

Further, in the setting/storage section 63 for the maximum permissible storage heat quantity (Qlm), data information for calculation corresponding to the maximum permissible storage heat quantity (Qlm) of the mounted X-ray tube is previously set and stored. The maximum permissible storage heat quantity (Qlm) is the maximum permissible storage heat quantity in a range which does not cause melting or other damage in the rotary anode or the like and corresponds to the upper limit which is set by taking the least sufficient safety factor into consideration. Then, the maximum permissible storage heat quantity (Qlm) is always supplied to the calculating section 65 for the present input permissible heat quantity (Qa).

The setting/storage section 66 for the correction functions K(p), L(T), M(f), N(r) contains a table for data information for calculation corresponding to the correction function (K(p)) previously determined as a value which depends on the anode input power (P) at the X-ray emission time based on the performance inherent to the mounted rotary anode type X-ray tube as is indicated by the concept thereof in FIG. 12A. The correction function (K(p)) is a coefficient which becomes larger as the anode input power (P) becomes larger.

Further, the correction function setting/storage section 66 contains a table of data information corresponding to the correction function (L(T)) previously determined as a value which depends on the X-ray emission continuation time (T) as shown in FIG. 12B. The correction function (L(T)) is a coefficient which becomes larger as the X-ray emission continuation time (T) becomes longer.

Further, the correction function setting/storage section 66 contains a table of data information for calculation corresponding to the correction function (M(f)) previously determined as a value which depends on the focal point size (f) as shown in FIG. 12C. The correction function (M(f)) is a coefficient which becomes smaller as the focal point size (f) becomes larger.

Further, the correction function setting/storage section 66 contains a table of data information corresponding to the correction function (N(r)) previously determined as a value which depends on the anode rotation speed (r) of the anode as shown in FIG. 12D. The correction function (N(r)) is a coefficient which becomes smaller as the anode rotation speed (r) becomes higher. The above correction functions are one example of a mode in which the X-ray is continuously emitted.

Next, the operation control of each control means is explained with reference to FIG. 13. The main power supply of the CT scanner is turned ON to start the X-ray photographing service for one day, for example. When the first X-ray photographing is started, the storage heat quantity of the rotary anode is time-sequentially calculated by the microcomputer in the calculating section 64 for the present anode storage heat quantity (Qt) together with the clock operation.

It is assumed that the first X-ray photographing condition is set in a continues X-ray emission mode in which the anode voltage is 125 kVp, the anode current is 320 mA, the focal point size is large, the anode rotation speed is 50 rps, and the X-ray emission continuation time T is 60 sec, for example. If the photographing mode is selected, the anode input power (P=40 kW) for the condition is calculated and data information corresponding thereto is supplied to the calculating section 64 for the present anode storage heat quantity (Qt). In the calculating section 64, data information for calculation corresponding to the heat quantity rise predicting value (St) which corresponds to (P=40 kW) of FIG. 3 which is input, set and stored in the table of the setting/storage section 61 for the storage heat quantity rise predicting value (St) is read out from the table and the anode storage heat quantity is time-sequentially calculated according to data information of the x-ray emission continuation time (T) supplied thereto.

If the first X-ray photographing is terminated in the photographing continuation time (T) as scheduled or the X-ray emission is interrupted in the course of the operation, corresponding data is supplied to the calculating section 64 together with data of photographing time. In this case, data information which falls from the achieved anode storage heat quantity according to the storage heat quantity fall predicting value (Ct) by the cooling operation of FIG. 3 which is previously set and stored in the table of the setting/storage section 62 for storage heat quantity fall predicting value (Ct) by cooling is read out and the anode storage heat quantity is time-sequentially calculated. Thus, the calculating section 64 for present anode storage heat quantity (Qt) time-sequentially calculates the present storage heat quantity stored in the anode irrespective of the X-ray emission time or wait time.

Then, it is assumed that the anode voltage is set to 125 kvp, the anode current is set to 400 mA, the X-ray emission continuation time T is set to 30 sec, and the other conditions are kept the same as that in the first-time photographing by use of the photographing condition setting section 70 as the next X-ray photographing condition. Assume now that it is at the time t1 of the cooling process in the wait state for photographing as shown in FIG. 13. The anode storage heat quantity at the time t1 is (Qt1) and is held in the present anode storage heat quantity calculating section 64 as the result of calculation.

Then, the signal for next photographing condition is supplied to the calculating section 64 and is also supplied to the calculating section 67 for next imaginary anode storage heat quantity (Qs) in the next X-ray emitting condition and the next imaginary anode storage heat quantity (Qs) is calculated. In this case, the data tables as schematically shown in FIGS. 12A to 12D and previously stored in the function setting/storage section 66 are accessed and the correcting functions K(p), L(T), M(f), N(r) of the condition which coincides with or approximately equal to the predicted photographing condition are read out from the respective tables. Then, the next imaginary anode storage heat quantity (Qs)in the next photographing condition is calculated by use of the following equation.

$$Qs=P\cdot T\cdot[K(p)\cdot L(T)\cdot M(f)\cdot N(r)]$$

Figure 13:
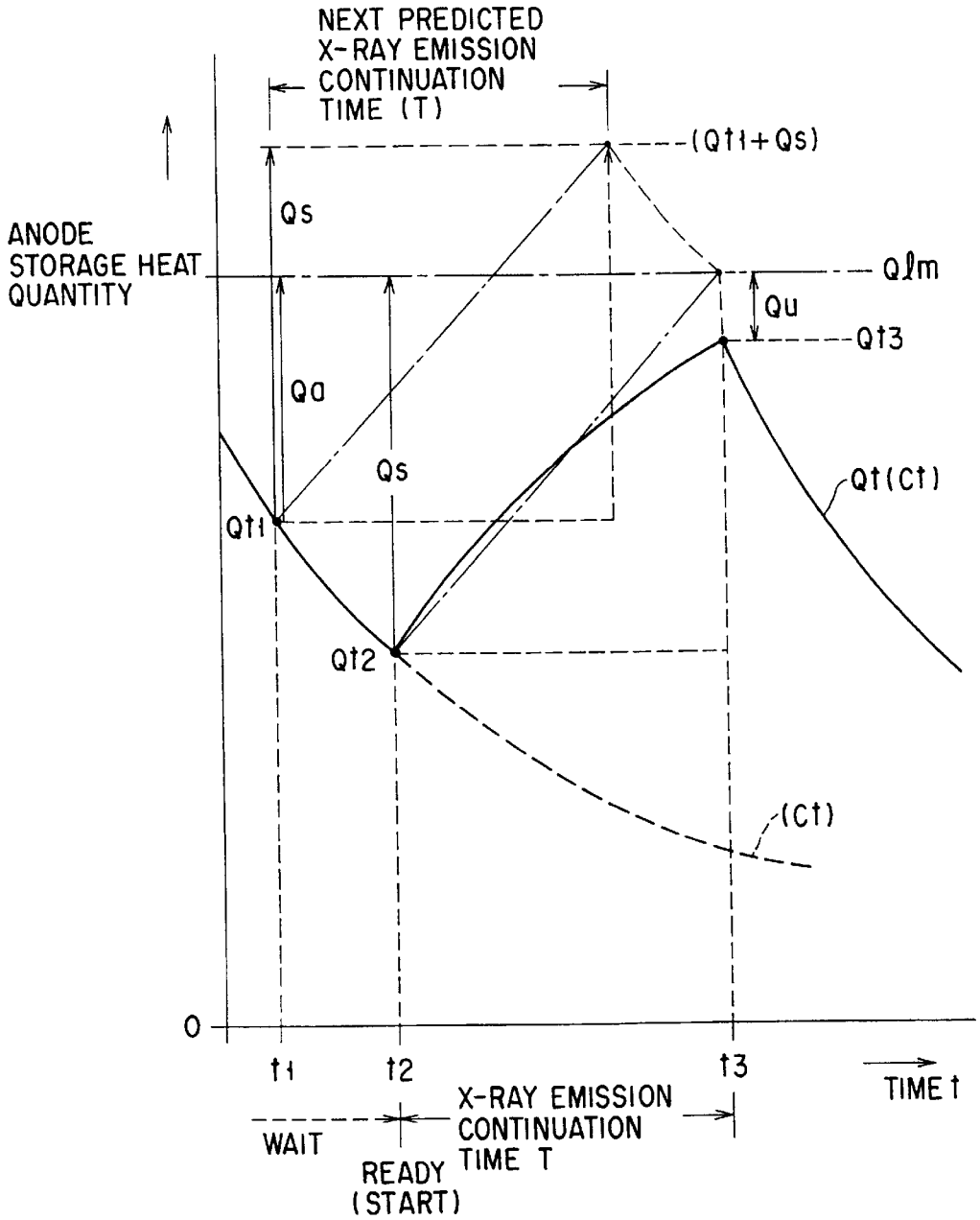
FIG. 13 is a graph for illustrating a control method based on the tables shown in FIGS. 12A, 12B, 12C and 12D.

As shown in FIG. 13, the next imaginary anode storage heat quantity (Qs) corresponds to the heat quantity added to the present anode storage heat quantity (Qt1) in the next predicted X-ray emission continuation time (T) and corresponds to the imaginary heat quantity calculated by using the correction function corresponding to the magnitude of the anode input power or the like.

In the calculating section 65 for present input permissible heat quantity (Qa), a difference (Qa=Qlm−Qt) between the maximum permissible storage heat quantity (Qlm) supplied from the maximum permissible storage heat quantity (Qlm) setting/storage section 63 and the present anode storage heat quantity (Qt) time-sequentially supplied from the present anode storage heat quantity (Qt) calculating section 64 is calculated and the result of calculation is supplied as the present input permissible heat quantity (Qa) to the comparing/signal generating section 68 for permitting or inhibiting the next X-ray emission. The present input permissible heat quantity (Qa) corresponds to the heat quantity of a difference between the maximum permissible storage heat quantity (Qlm) shown in FIG. 13 and the anode storage heat quantity (Qt1) at the time t1.

In the comparing/signal generating section 68 for permitting or inhibiting the next X-ray emission, the present input permissible heat quantity (Qa) supplied from the present input permissible heat quantity (Qa) calculating section 65 and the next imaginary anode storage heat quantity (Qs) supplied from the calculating section 67 for the next imaginary anode storage heat quantity (Qs) in the next X-ray emitting condition are compared with each other.

If the difference (Qa−Qs) is negative, the storage heat quantity obtained by adding the present anode storage heat quantity (Qt1) to the next imaginary anode storage heat quantity (Qs) exceeds the maximum permissible storage heat quantity (Qlm) in the condition determined as the next photographing condition and it is determined that the X-ray emission is inhibited, and a signal (Wait) indicating the wait sate is supplied to the operating section 69. Therefore, the wait instruction state is continued until the time t2 shown in FIG. 13.

If the difference (Qa−Qs) is zero or positive, it is determined that the X-ray photographing can be completed without causing any damage on the X-ray tube in the condition determined as the next photographing condition, and a signal (Ready) indicating permission of the X-ray emission is supplied to the operating section 69. Therefore, a state in which the next photographing is permitted is set when the time t2 shown in FIG. 13 is reached. That is, at the time t2, the storage heat quantity obtained by adding the present anode storage heat quantity (Qt2) to the next imaginary anode storage heat quantity (Qs) in the next X-ray emitting condition becomes equal to or lower than the maximum permissible storage heat quantity (Qlm).

At the same time, in the X-ray apparatus, the above-described calculations for photographing are effected after the next predicted photographing condition is set. As is clearly understood from FIG. 13, the time at which the photographing in the next predicted photographing condition becomes possible is time-sequentially calculated by the above calculations. Therefore, the wait time from a certain time, for example, time t1 to the time t2 at which the photographing is permitted is simultaneously calculated at the time t1 and the wait time to permission of the photographing is displayed on the wait time display section 71 of the photographing inhibition/wait display section (Wait). The wait time is time-sequentially reduced and becomes zero at the time t2. After this, the X-ray photographing can be attained without causing any damage in the set photographing condition if the operator depresses the photographing start button (Start).

Thus, after the photographing permissible time t2, the X-ray photographing can be made without causing any damage in the next photographing condition and the photographing can be started in the above condition by turning ON the photographing start button (Start) of the operating section. The photographing is terminated at the time t3 after elapse of the X-ray emission time T.

The anode storage heat quantity from the photographing start time t2 to the photographing end time t3 is calculated by the calculating section 64 for present anode storage heat quantity (Qt) according to the preset storage heat quantity rise curve (St) inherent to the X-ray tube. Therefore, the actual anode storage heat quantity (Qt3) at the photographing end time t3 is suppressed to a value smaller than the maximum permissible storage heat quantity (Qlm). Since the difference (Qu) therebetween is a variation safety factor corresponding to an amount added as the function of input power (P) or the like, the difference (Qu) becomes larger as the input power (P) becomes higher, for example, and thus it can be prevented with high reliability that the temperature at the electron beam incident point of the X-ray tube focal point area will exceed the maximum limit temperature even at the time of photographing with higher anode input power.

Further, since the calculation for determining permission or inhibition of the photographing in the next predicted photographing condition is the calculation for a case wherein the heat quantity is lowered from the anode storage heat quantity (Qt3) at the photographing end time t3 by cooling, the wait time for the next photographing substantially becomes shorter than in a case where the calculation is made on the assumption that the heat quantity is lowered from the maximum permissible storage heat quantity (Qlm). The above data calculation can be completed within 0.5 sec, for example, by use of the calculation processing ability of the present-day microcomputer. After this, since it is predicted that the calculation processing ability of the computer will be further enhanced, time required for the above calculation process will be further shortened.

It is possible to time-sequentially calculate the predicted achievable anode storage heat quantity (Qt3) in the next predicted photographing condition by using adequate correction functions based on the thermal characteristic of the rotary anode of the mounted X-ray tube and compare the same with the maximum permissible storage heat quantity (Qlm) to attain a permission or inhibition control data signal. However, at this stage, it takes a relatively long time to perform the calculation process in comparison with the above embodiment and the above method can be applied to an X-ray apparatus in which the control operation may be effected at a relatively slow pace.

In the above embodiment, as the correction functions and the tables therefor used in the calculation in the calculating section 67 for imaginary anode storage heat quantity (Qs) in the next X-ray emitting condition, the correction function (L(T)) of X-ray emission continuation time (T), the correction function (M(f)) of focal point size (f) and the correction function (N(r)) of anode rotation speed (r) are used in addition to the correction function (K(p)) of next anode input power (P), but the apparatus structure does not necessarily include all of them.

For example, when taking the degree of influence on the temperature variation of the anode into consideration, one of the above correction functions, for example, the correction function (K(p)) of the next anode input power may be used, or the correction function (M(f)) of the focal point size may be additionally used. In the microcomputer calculation, since the time required for calculations becomes shorter as the number of accesses to the data tables of the above correction functions is less, the X-ray emission control operation can be effected more rapidly as the number of correction functions used is less and it is preferable to use a smaller number of correction functions.

Judging from this, it is particularly suitable to control the above calculations and X-ray emission while the anode is rotated at substantially the same rotation speed at the time of X-ray photographing and in the wait state in a case of a rotary anode type X-ray tube in which the mounted X-ray tube is provided with the hydrodynamic slide bearing having the helical grooves. This is because the hydrodynamic slide bearing has a larger bearing resistance than the ball bearing and it is difficult to finely or rapidly change the anode rotation speed by a large amount. Therefore, it is preferable to continue the X-ray photographing service of one day, for example, while the anode is kept rotated at substantially the same anode rotation speed at the time of X-ray photographing and in the wait state. Thus, wear of the bearing becomes less. Further, since the anode rotation speed is substantially constant, the correction function for the anode rotation speed can be omitted and the calculation processing time can be further reduced.

Further, a case where coefficients individually associated with the input power, focal point and the like are provided in the respective tables is not limited and it is possible to use one data table of the function G(p, T, f, r) associated with a plurality of parameters such as the anode input power, focal point size, anode rotation speed, photographing time, for example.

In the above embodiment, the result of calculation using the above functions is controlled such that the imaginary anode storage heat quantity (Qs) in the next X-ray emitting condition is set higher than the actual heat quantity (Qt) but this is not limitative. That is, as shown in FIG. 14, the result of calculation using the functions in the next X-ray emitting condition may be controlled such that the value of the maximum permissible storage heat quantity (Qlm) is reduced by an amount corresponding to the functions and set as an imaginary permissible limit storage heat quantity (Qln) in the next photographing condition.

Figure 14:
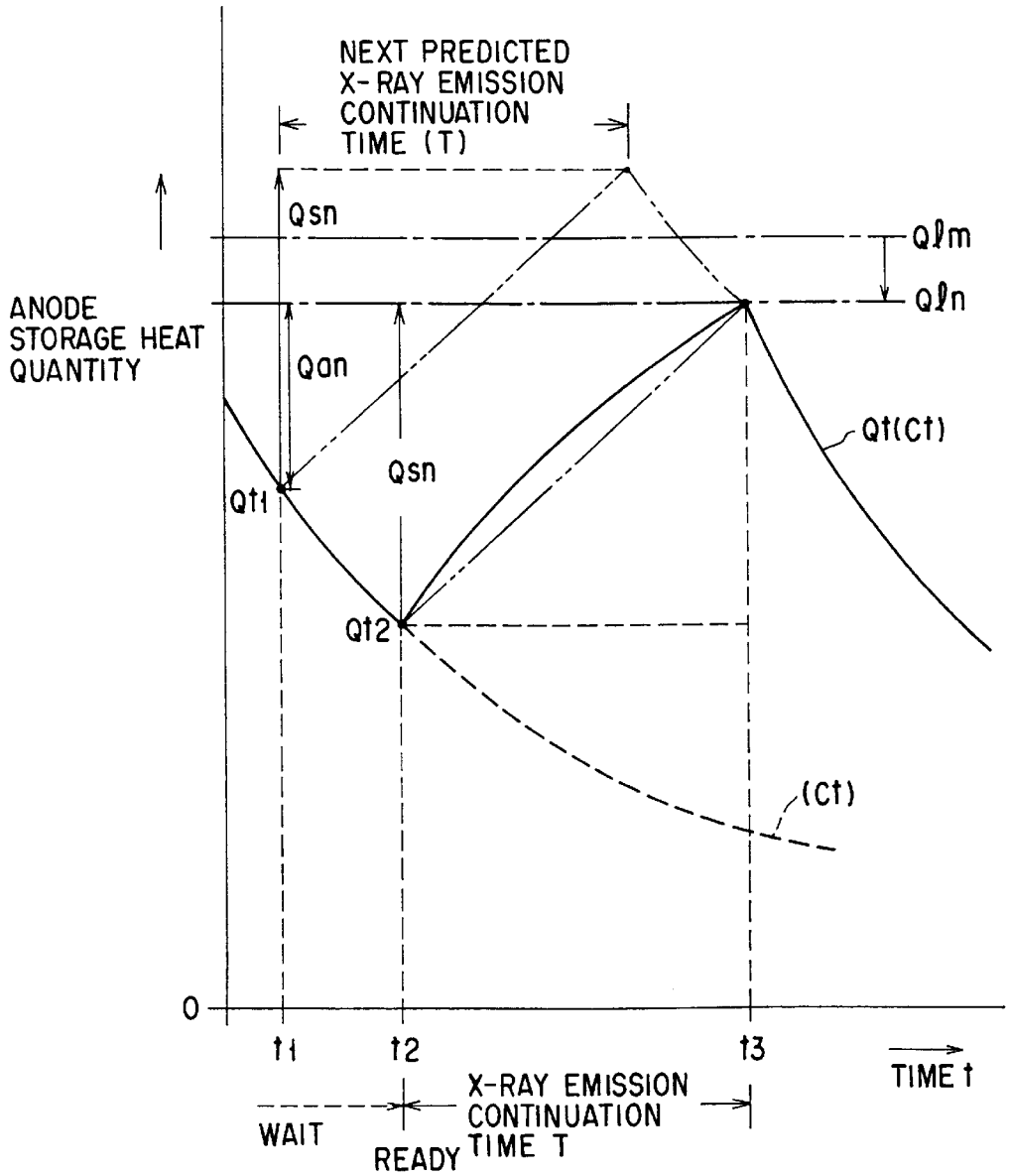
FIG. 14 is a graph for illustrating another control method based on the tables shown in FIGS. 12A, 12B, 12C and 12D.

In this case, as shown in FIG. 14, at the time t1 in the cooling period, since the storage heat quantity (Qsn) in the next photographing condition added to the present anode storage heat quantity (Qt1) significantly exceeds the present input permissible heat quantity (Qan) with respect to the imaginary permissible limit storage heat quantity (Qln), the control operation is effected so as not to permit the photographing operation in the next photographing condition. Then, when the time t2 is reached, the photographing operation is permitted. The storage heat quantity between the photographing operations is controlled by making the calculation according to the preset rise characteristic of the actual storage heat quantity inherent to the X-ray tube.

In the X-ray CT scanner which is now practiced, it is general to perform successive X-ray photographing operations by continuously emitting the X-ray for 30 sec, for example, with a constant anode input power (P). However, it is possible to intermittently effect the X-ray emission or change the anode input power (P) according to the property of the photographed object in the successive X-ray photographing operations.

Figure 15A:
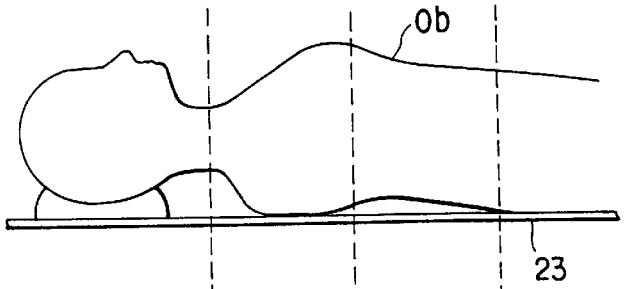
FIGS. 15A and 15B are graphs for illustrating a control method for an X-ray apparatus for a to-be-photographed object according to another embodiment of this invention.
Figure 15B:
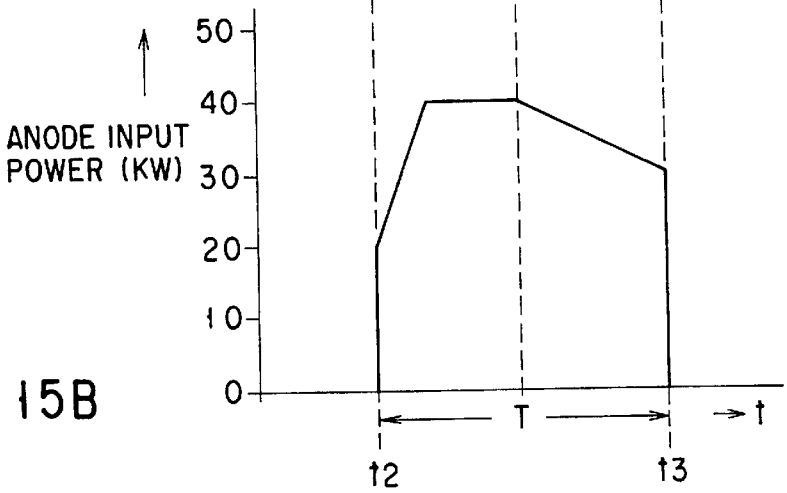

An embodiment shown in FIGS. 15A and 15B is an example in which the X-ray amount applied to a to-be-photographed object Ob for tomogram is suppressed to a necessary least amount, the input anode power (P) is changed along the profile shown in the drawing according to the distribution of the X-ray absorption amount of the photographed portion during the successive X-ray emission continuation time (T) (for example, T=30 sec) in order to obtain an X-ray image of required good quality, and thus a photographing mode is set.

That is, the anode power of 20 kW is input at the X-ray emission start time (t2) at which the X-ray photographing operation is started from a portion with relatively small X-ray absorption rate. Then, the anode power is gradually increased to 40 kW as the photographed portion is changed and the X-ray absorption rate is gradually increased, the anode power is kept at the same value for preset time, and then it is gradually lowered to 30 kW.

If the photographed object has a definite shape to some extent such as a man, it is possible to prepare programs of the changing control mode of the anode input power P for respective ranges of the main photographed portions and permit the operator to adequately select them and take X-ray photographs.

In the case of X-ray emission mode, the next predicted anode input total heat quantity (Qsn) in the next X-ray emitting condition can be obtained by the following equation.

$$Qsn=\int P(T)\cdot dt$$

Further, a change in the anode storage heat quantity during the X-ray emission continuation time (T) can be calculated and the factors can be set as correction functions for the respective changing control modes.

Therefore, data information corresponding to the correction function is previously stored in the data table as a value which depends on the profile of the anode input power P and the input total heat quantity (Qsn) for each control mode program and the apparatus can be constructed to perform the calculation process by taking the correction function data information into consideration.

Figure 16A:
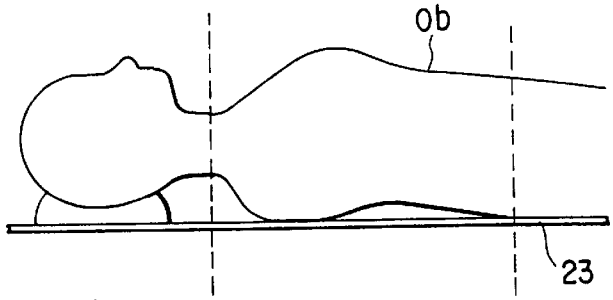
FIGS. 16A and 16B are graphs for illustrating a control method for an X-ray apparatus for a to-be-photographed object according to still another embodiment of this invention.
Figure 16B:
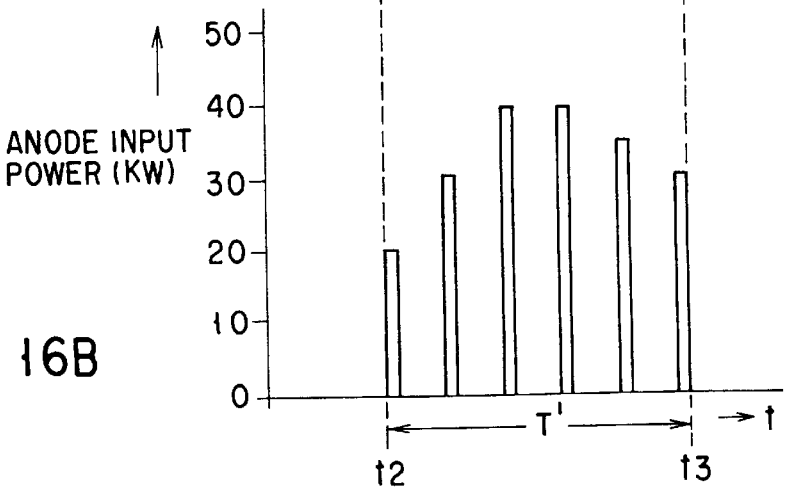

Further, an embodiment shown in FIGS. 16A and 16B shows a case wherein tomograms of the ranges of the photographing portions are taken at a certain interval in the successive X-ray photographing operations. This is a mode in which the actual X-ray emission is intermittently repeated in the successive X-ray emission continuation time (T') while a bed 23 on which the object Ob is placed is moved at a constant sped in the left direction in the drawing.

That is, this is a set example of a mode in which the X-ray emission of one second and then the X-ray emission wait state of 4 sec are repeated in the successive X-ray emission continuation time (T') (for example, T=27 sec) and the anode input power (P) at each time of X-ray emission is changed as shown in the drawing for photographing. For example, a tomograph of one or two slices is taken by the X-ray emission of one second, the photographing position is changed in the period of 4 sec, and then the same photographing operation is effected.

Also, in this case, the correction function of the successive photographing modes is previously set based on the magnitude of the anode input power (P), a rise in the anode storage heat quantity caused by the X-ray emission of one second and the history of a reduction in the heat quantity for 4 sec and the anode heat quantity can be calculated by the computer by using the function. If the intermittent emission mode and the correction functions corresponding thereto are set, an apparatus which can be controlled by the calculation process in a sufficiently short period of time can be realized.

This invention is not limited to the CT scanner and can be applied to a general medical photographing device, industrial X-ray photographing device, X-ray exposure device, and other types of X-ray devices. Further, the rotary anode type X-ray tube mounted is suitable for an X-ray tube having a hydrodynamic slide bearing which is difficult to instantaneously and finely change the anode rotation speed to an extremely high anode rotation speed since the bearing resistance is relatively large as described before, but it is not limited thereto and can be applied to an X-ray tube using a ball bearing or the like.

As described above, according to this invention, the performance or heat quantity of the mounted rotary anode type X-ray tube can always be fully utilized and the automatic control can be attained to always suppress the wait time to the next X-ray emission to minimum. Therefore, it is possible to attain the high-speed automatic control with high reliability in which the wait time to the next X-ray emission is short.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An X-ray apparatus comprising:

a rotary anode type X-ray tube including a rotary anode having an X-ray emission target section, a cathode for emitting an electron beam to the target section of said rotary anode, a rotary structure to which said rotary anode is fixed, a stationary structure for rotatably supporting said rotary structure, and a bearing disposed between said rotary structure and said stationary structure;

a power supply device for causing the electron beam to be incident on said rotary anode of said X-ray tube to emit X-ray radiation; and an X-ray emission control device for controlling the power supply device to control the X-ray radiation, said X-ray emission control device including:

first setting means for setting data information corresponding to a maximum permissible storage heat quantity (Qlm) of said rotary anode;

first calculating means for calculating data information corresponding to a present anode storage heat quantity (Qt) based on the cooling characteristic (Ct) of said rotary anode;

second calculating means for calculating data information corresponding to a next predicted anode input total heat quantity (Qsn) by calculation using data information corresponding to the anode input power (P) and X-ray emission continuation time (T) from the start of the X-ray emission to the end of the X-ray emission in the next predicted X-ray emitting condition;

second setting means setting data information which is at least one of data information corresponding to a correction function (K(p)) determined depending on the anode input power (P) of said X-ray tube, data information corresponding to a correction function (L(T)) determined depending on the X-ray emission continuation time (T), data information corresponding to a correction function (M(f)) determined depending on the X-ray focal point size (f), and data information corresponding to a correction function (N(r)) determined depending on the anode rotation speed;

third calculating means for calculating data information corresponding to a next imaginary anode storage heat quantity (Qs) in the next X-ray emitting condition by calculation using the at least one data information set by said second setting means and data information corresponding to the next predicted anode input total heat quantity (Qsn);

fourth calculating means for deriving data information indicating permission or inhibition of the X-ray emission in the next X-ray emitting condition by calculation using data information corresponding to the maximum permissible storage heat quantity (Qlm), the present anode storage heat quantity (Qt) and the next imaginary anode storage heat quantity (Qs);

third setting means for changing the anode input power (P) during the X-ray emission continuation time; and fourth setting means for intermittently effecting X-ray emission.

2. An X-ray apparatus according to claim 1, wherein said rotary anode of said X-ray tube includes a disk-like base body of refractory metal and a surface target section.

3. An X-ray apparatus according to claim 1, wherein said bearing of said X-ray tube is a hydrodynamic slide bearing having helical grooves and supplied with a metal lubricant which is liquid in the operation.

4. An X-ray apparatus comprising:

a rotary anode type X-ray tube including a rotary anode having an X-ray emission target section, a cathode for emitting an electron beam to the target section of said rotary anode, a rotary structure to which said rotary anode is fixed, a stationary structure for rotatably supporting said rotary structure, and a bearing disposed between said rotary structure and said stationary structure;

a power supply device for causing the electron beam to be incident on said rotary anode to emit X-ray radiation; and an X-ray emission control device for controlling the power supply device to control the X-ray radiation, said X-ray emission control device including:

first setting means for setting data information corresponding to a maximum permissible storage heat quantity (Qlm) of said rotary anode;

first calculating means for calculating data information corresponding to a present anode storage heat quantity (Qt) based on the cooling characteristic (Ct) of said rotary anode;

second calculating means for calculating data information corresponding to a next predicted anode input total heat quantity (Qsn) by calculation using data information corresponding to the anode input power (P) and X-ray emission continuation time (T) from the start of the X-ray emission to the end of the X-ray emission in the next predicted X-ray emitting condition; the anode input power (P) of said X-ray tube, data information correction to a correction function (L(T)) determined depending on the X-ray emission continuation time (T), data information corresponding to a correction function (M(f)) determined depending on the X-ray focal point size (f), and data information corresponding to a correction function (N(r)) determined depending on the anode rotation speed (r);

third calculating means for calculating data information corresponding to a next imaginary permissible limit storage heat quantity (Qln) in the next X-ray emitting condition by subtracting an amount corresponding to the correction function data information from the maximum permissible storage heat quantity (Qlm) by calculation using the at least one data information set by said second setting means and data information corresponding to the next predicted anode input total heat quantity (Qsn);

fourth calculating means for deriving data information indicating permission or inhibition of the X-ray emission in the next X-ray emitting condition by calculation using data information corresponding to the next imaginary permissible limit storage heat quantity (Qln), the present anode storage heat quantity (Qt) and the next predicted anode input total heat quantity (Qsn);

third setting means for changing the anode input power (P) during the X-ray emission continuation time; and fourth setting means for intermittently effecting X-ray emission.

5. An X-ray apparatus according to claim 4, wherein said rotary anode of said X-ray tube includes a disk-like base body of refractory metal and a surface target section.

6. An X-ray apparatus according to claim 4, wherein said bearing of said X-ray tube is a hydrodynamic slide bearing having helical grooves and supplied with a metal lubricant which is liquid in the operation.

* * * * *